US006947007B1

(12) United States Patent
Rohde et al.

(10) Patent No.: US 6,947,007 B1
(45) Date of Patent: Sep. 20, 2005

(54) SHORTENED DIPOLE AND MONOPOLE LOOPS

(75) Inventors: Ulrich L. Rohde, Upper Saddle River, NJ (US); Klaus Danzeisen, Graefelfing (DE)

(73) Assignee: Synergy Microwave Corporation, Paterson, NJ (US)

( * ) Notice: Subject to any disclaimer, the term of this patent is extended or adjusted under 35 U.S.C. 154(b) by 81 days.

(21) Appl. No.: 10/362,499

(22) PCT Filed: Nov. 16, 2000

(86) PCT No.: PCT/EP00/11402

§ 371 (c)(1),
(2), (4) Date: Feb. 21, 2003

(87) PCT Pub. No.: WO02/17433

PCT Pub. Date: Feb. 28, 2002

(30) Foreign Application Priority Data

Aug. 21, 2000 (DE) ..... 100 40 794

(51) Int. Cl.[7] ..... H01Q 9/26
(52) U.S. Cl. ..... 343/804
(58) Field of Search ..... 343/802, 803–804, 343/812–815, 820, 823, 834, 843, 844

(56) References Cited

U.S. PATENT DOCUMENTS 5,886,669 A * 3/1999 Kita ..... 343/718
6,028,564 A * 2/2000 Duan et al. ..... 343/818
6,097,347 A * 8/2000 Duan et al. ..... 343/802
6,204,824 B1 * 3/2001 Davi et al. ..... 343/803

OTHER PUBLICATIONS

Caron, W. "The Hairpin Monopole Antenne, " http://www.antennex.com/preview/monopole.htm, Dec. 30, 2004.
Nikolova, N., "Lecture 10: Other Practical Dipole/Monopole Geometries. Matching Techniques for Dipole/Monopole Feeds," http://www.ece.mcmaster.ca/facualty/georgleva/antenna dload/, 2003.

* cited by examiner

*Primary Examiner*—Don Wong
*Assistant Examiner*—Minh Dieu A
(74) *Attorney, Agent, or Firm*—Lewis, Rice & Fingersh, L.C.

(57) ABSTRACT

The invention relates to dipole and monopole loops with a much shortened emitter relative to the theoretical length thereof and electrically extended at the ends thereof by non-emitting conductor pieces.

34 Claims, 2 Drawing Sheets

SHORTENED DIPOLE AND MONOPOLE LOOPS

BACKGROUND

1. Field of the Invention

The invention relates to a dipole loop (folded dipole) or monopole loop.

2. Description of the Related Art

A dipole loop or folded dipole consists of two closely adjacent lambda/2 dipoles, connected at the ends, but only one of which is fed. The same current direction is set on the dipoles. Both dipoles support one another in their action. By means of different thicknesses of the two dipoles the input impedance can be influenced via transformatory effects. A so-called monopole loop, which can be interpreted as a half dipole loop on a conducting plane and consists of two lamda/4 long dipoles, which again are arranged closely adjacent and are connected to one another at the upper end, acts on the same principle. Dipole or monopole loops of this kind on a conducting plane are used as transmitting and receiving aerials in the short- and ultra-short-wave range in various embodiments.

Radio operation is also carried out in the so-called threshold wave range in amateur and also military radio. The lowest practical frequency is approximately 1.5 MHz, which corresponds to a wavelength of just under 200 meters. A conventional lambda/2 aerial would consequently have a length of approximately 100 meters, the implementation of which as a horizontal or vertical aerial means a considerable mechanical outlay. It is known to shorten such aerials mechanically with respect to their theoretical length and to balance the associated disadvantage in efficiency by suitable measures, such as roof capacities and/or series inductivities, but these known solutions also require a further considerable outlay, especially with, an aerial in multi-band operation.

SUMMARY

It is therefore the object of the invention to create a dipole loop (folded dipole) or monopole loop, which, in spite of much shortening, to for example only 5 to 10% of the operational wavelength, has an adequately large radiation resistance of more than 10 ohms, this being without the use of discrete transformation elements such as roof capacities or inductivities.

This object is achieved for a dipole or monopole loop by the measures according to coordinated claims 1 and 2. Advantageous further developments emerge from the subordinate claims.

A dipole or monopole loop according to the invention can be greatly shortened, for example to only 5 to 6% of the operational wavelength at the lowest operational frequency, so the mechanical length of a dipole loop for an operational frequency of 1.5 MHz is equal to a mechanical length of only 10 to 12 meters. In spite of this the radiation resistance is still adequately great and greater than 10 ohms. Therefore a dipole loop of this kind according to the invention has almost equally good properties as a normal lamda/2 dipole. Tests have shown that the efficiency of the emitting aerial part of an aerial according to the invention is also more than 50% at 1.8 MHz and more than 80% at 3.6 MHz without loss of matching elements and earth losses, in other words in this respect too equally good properties as with a lamda/2 dipole are achieved. In spite of this, the dipole or monopole loop according to the invention can be constructed very simply and cost-effectively, as only one non-emitting conductor piece of appropriate length is placed on the ends. Geometrically complicated roof capacities in the form of stretched out wires or complicated shortening coils in the dipole are avoided. The use of a non-emitting conductor piece for compensating the shortening of the emitter is also particularly advantageous owing to the small losses of such conductor pieces. The arrangement according to the invention is also especially suitable for the construction of multi-band aerials, which can easily by switched over in frequency. A vertical dipole according to the invention can also still generate even radiation at relatively low frequencies owing to its small length. The field strength of the aerial in the near field is therein relatively low downwards, so the strict regulations for operating such transmitting aerials can easily be complied with.

The principle according to the invention can be applied in all the normal known forms of dipole and monopole loops, both with simple emitting dipoles and with reflectors or directors of more complex aerial arrangements and also with logarithmic-periodic aerials which are constructed with dipole or monopole loops of this kind. Existing aerials can also be supplemented or converted with little outlay according to the principle according to the invention. As the switchover devices assigned to the non-emitting conductor pieces can easily be remote-controlled, an aerial consisting of several dipole loops can be tuned not only to optimal radiation resistance, but also to an optimal reflection factor or direction factor.

DESCRIPTION OF PREFERRED EMBODIMENT(S)

The invention is explained in detail below using embodiment examples with the aid of schematic drawings.

Figure 1:
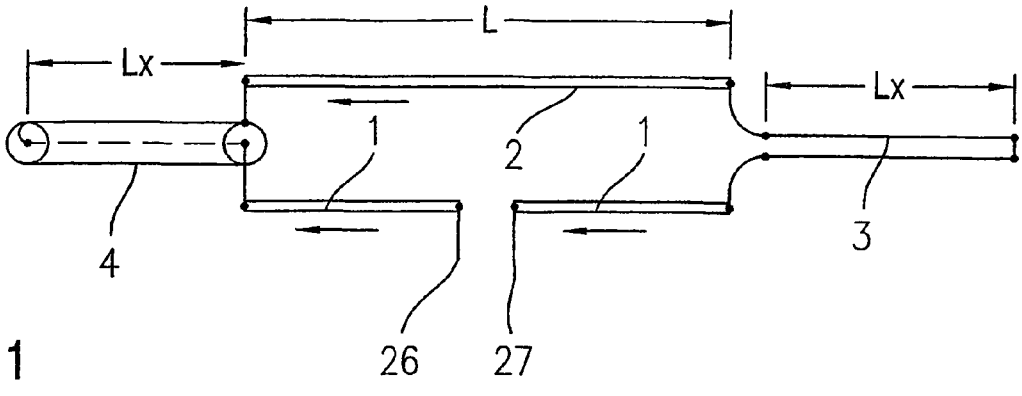
FIG. 1 shows schematically a dipole loop according to the invention operated as a horizontal emitter.

FIG. 1 shows schematically a dipole loop according to the invention operated as a horizontal emitter. It consists of two parallel dipole emitters 1 and 2, much shortened compared to the theoretical length lamda/2, which are arranged parallel next to one another at a short distance of less than lamda/20 and of which only one dipole emitter 1 is fed in the centre. The mechanical length L of these two dipole emitters 1, 2 is equal, for example, to only 6% of the operational wavelength lamda; for the lower threshold frequency of 1.5 MHz of the threshold wave range this means a mechanical length of only L=12 meters. To both ends of these dipole emitters 1, 2 a non-emitting conductor piece is connected in each case, this being either in the form of a parallel wire overhead line 3, as illustrated for the right end of the dipole, or in the form of a non-symmetrical coaxial cable 4, as illustrated at the left end of the dipole. The length Lx of this non-emitting conductor piece 3 or 4 is chosen in such a way that, taking into account the shortening factor associated with the conductor piece (depending on the dielectric of the line 3 or the coaxial cable 4), the dipole loop overall reaches its theoretical length of lamda/2 again. By means of this non-emitting conductor piece on the ends of the much shortened dipole emitters 1, 2 the radiation resistance is appreciably increased compared with the non-shortened dipole and thus the unfavourable frame aerial effect avoided, so in spite of much shortening of the emitting aerial part almost equally high efficiency as with a lamda/2 dipole is achieved and this with problem-free radiation resistance of the dimension of the impedance of the source or the consumer.

Figure 2:
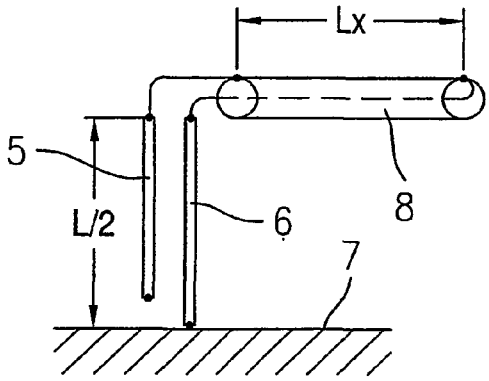
FIG. 2 shows a monopole loop of two parallel monopoles, which are much shortened compared to the theoretical length of lamda/4 and arranged on a conducting plane.

The same principle can also be applied according to FIG. 2 with so-called monopole loops which consist of two parallel monopoles 5 and 6, which are much shortened compared to the theoretical length of lamda/4 and arranged on a conducting plane 7. They represent one half of a dipole loop which is reflected on the conducting plane 7. Here too the monopole emitters 5, 6 are much shortened compared to the wavelength and are electrically extended by a non-emitting conductor piece 8 connected to the upper ends, as indicated again in FIG. 2 by a coaxial cable.

Figure 5:
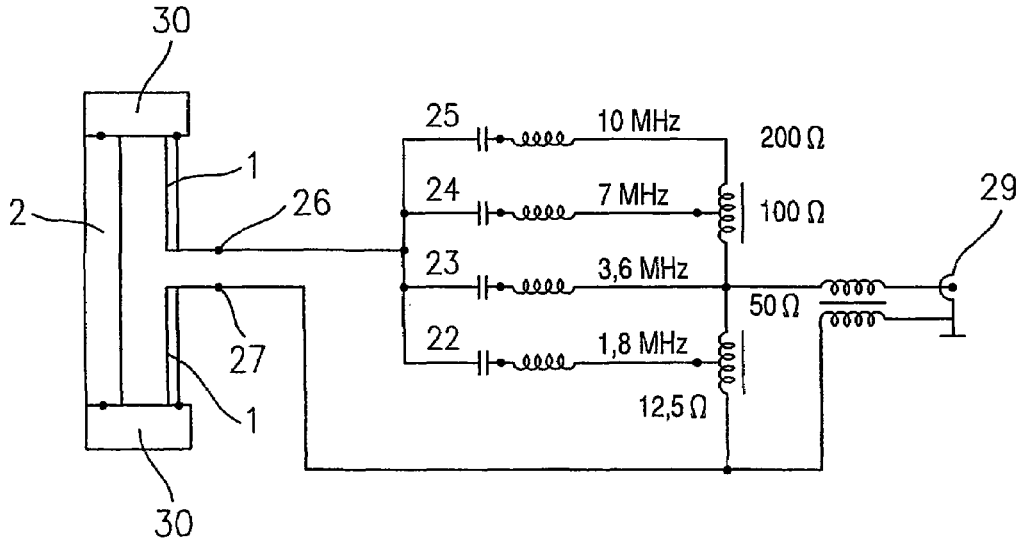
FIG. 5 shows an embodiment of an adaptation circuit.

The non-emitting conductor pieces 3, 4 and 8 can be accommodated mechanically in a small housing 30 attached according to FIG. 5 to the dipole ends or in the centre of the dipole. Once one of the emitters is constructed as a hollow tube, which is usually the case anyway with dipole or monopole loops of this kind for reasons of transformation, the additional non-emitting conductor piece can also easily be accommodated in this hollow tube. With higher frequencies, which require a short circuit inside the hollow tube, the non-emitting conductor piece accommodated inside the hollow tube is connected to the actual switching device attached outside the hollow tube via an additional extension line, this extension lire being either lamda/2 or lamda or a multiple of lamda long. In this way the actual switching can be carried cut, for example, in the central housing 30, while the non-emitting conductor piece is attached in the hollow tube. In many cases, especially in the use of overhead lines, additional shielding of the non-emitting conductor pieces can be advantageous.

Figure 3:
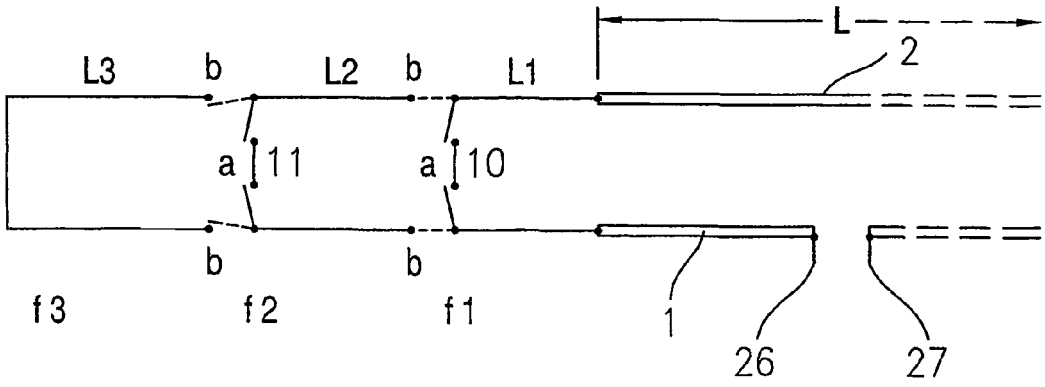
FIG. 3 shows a dipole loop according to the invention, which can be switched over to several frequency ranges.

FIG. 3 shows a dipole loop according to the invention, which can be switched over to several frequency ranges. Via a suitable switchover device non-emitting conductor pieces of different lengths can be connected to the ends of the dipole loop. In the embodiment example according to FIG. 3 this is done by means of relay switches 10 and 11, which are switched at predetermined intervals into the non-emitting conductor piece, illustrated in this embodiment example as a two-wire line. This conductor piece consists in the embodiment example of three conductor pieces of lengths L1, L2 and L3. If both switches 10 and 11 occupy switching position a illustrated in FIG. 3, only conductor piece L1 is connected to the emitting part 1, 2 of the dipole loop, corresponding to an operational frequency f1. If switch 10 occupies switching position b, conductor piece L2 is also additionally connected, corresponding to an operational frequency f2. If, finally, switch 11 also occupies the other switching position b, conductor piece L3 is also connected, corresponding to the lowest operational frequency f3.

Figure 4:
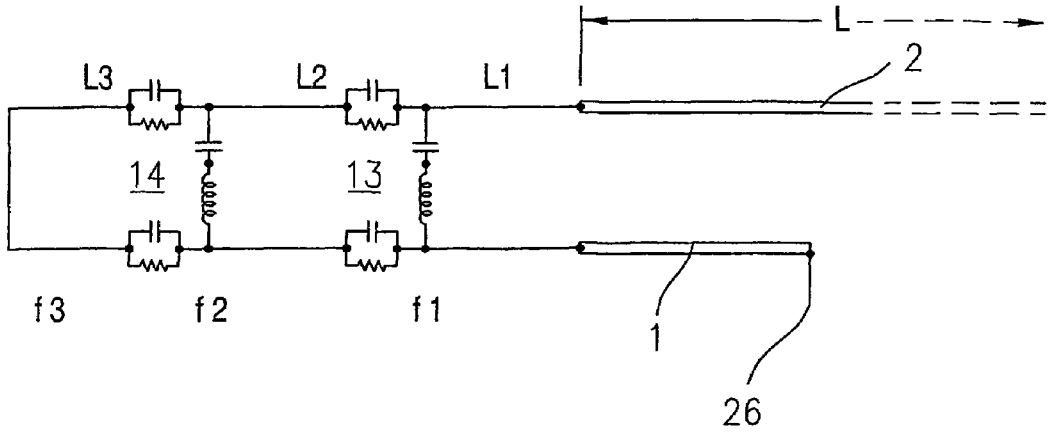
FIG. 4 shows another embodiment of a dipole loop which can be switched over several frequency ranges.

FIG. 4 shows another possibility for this kind of switching over of the frequency of the aerial. The relay switches in this embodiment example are replaced by filter circuits 13 and 14, consisting of a series resonance circuit and two parallel resonance circuits and tuned to the corresponding operational frequencies f1 and f2. In this way automatic multi-band operation of an aerial of this kind is possible without switching over.

The arrangement according to FIG. 3 with relay switches is suitable for transmitting aerials of high output with more than 100 watts and the arrangement according to FIG. 4 with resonance circuits is suitable for average outputs of up to 100 watts. A combination of mechanical switches and filter circuits can also be advantageous in many cases of application.

By binary grading of the conductor pieces L1, L2 and L3 of different lengths, quasi continuous adjustment can be achieved in that the first conductor piece L1 is chosen for example as 2°=1 unit, the second conductor piece L2 as 21=2 units and the third conductor piece L3 as 22=4 units in length, so in this way all the possible lengths can be set. It is therein advantageous to relate the tuning step width to the VSWR (voltage standing wave ratio) bandwidth, in other words, for example, in the threshold wave range for a VSWR less than 2 to choose a step width of 50 to 100 KHz. A combination of conductor pieces switched depending on band and conductor pieces switched quasi continuously can be useful in many cases of application.

In order to match the real radiation resistance of the aerial, which is usually too low in ohms, better to the impedance of the source or the consumer, it can be advantageous to construct the fed part 1 or 5 of the dipole loop according to FIG. 1 or of the monopole loop according to FIG. 2 from several parallel emitters, which with aid of a relay switching matrix can then be switched over in such a wav that the transformation ratio can be altered in discrete steps over a wide range and matched to the source or the consumer. Where, for example, three such parallel emitters are used, the transformation ratio can be switched between 1:4 via 1.9 to 1:16 appropriate switching.

Aerial matching devices available on the market can be used to match a dipole loop according to the invention at the feed point to a feed cable leading to the transmitter or receiver. It has proved particularly advantageous with multi-band operation to use an adaptation circuit according to FIG. 5, consisting of two 1:4 transmitters 20, 21, switched in cascade, the taps of which are connected in each case to feed points 26, 27 of the dipole loop via series resonance circuits 22 to 25. The nominal resonance frequency of these series resonance circuits 22 to 25 corresponds in each case to the centre of the user bands to which the dipole loop is to be able to be switched over. The transmitters 20, 21 are connected to the feed cable 29 via a balancing transmitter 28 (balun). The impedance of the transmitters at the respective taps is chosen to correspond to the real part of the radiation resistance. For the first tap, which is connected to the dipole via series resonance circuit 22 this real part is, for example, 12.5 ohms, for the second tap 50 ohms, for. the third tap 100 ohms and for the entire cascade of the two transmitters 200 ohms. The imaginary part of the aerial impedance is compensated by slight detuning of series Circuits 22 to 25. In this wav a desired VSWR of less than 2 can be maintained.

What is claimed is:

1. A folded dipole antenna for receiving signal of a particular wavelength (lambda), the antenna comprising:

two dipole emitters, each of said dipole emitters having a first end, a second end, and a length therebetween, said first dipole emitter being arranged parallel to said second dipole emitter and each of said lengths being less than half said wavelength (lambda/2) associated with said folded dipole antenna;

a first non-emitting conductor piece attached to both said first end of said first dipole emitter and said first end of said second dipole emitter; and a second non-emitting conductor piece attached to both said second end of said first dipole emitter and said second end of said second dipole emitter.

2. The folded dipole antenna of claim 1 wherein each of said lengths is between about 5% and about 10% of said wavelength.

3. The folded dipole antenna of claim 2 wherein each of said lengths is about 6% of said wavelength.

4. The folded dipole antenna of claim 1 wherein at least one of said first non-emitting conductor piece and said second non-emitting conductor piece are accommodated in an electromagnetic shield.

5. The folded dipole antenna of claim 1 wherein at least one of said first non-emitting conductor piece and said second non-emitting conductor piece comprises a two wire line short-circuited at the end.

6. The folded dipole antenna of claim 1 wherein at least one of said first non-emitting conductor piece and said second non-emitting conductor piece comprises a co-axial cable short-circuited at the end, the inner conductor of said co-axial cable being connected to said first dipole emitter, the outer conductor of said co-axial cable being connected to said second dipole emitter.

7. The folded dipole antenna of claim 1 wherein at least one of said first non-emitting conductor piece and said second non-emitting conductor piece can be switched over to two or more different lengths.

8. The folded dipole antenna of claim 7 wherein said switching is accomplished by relay switches assigned to said dipole emitters.

9. The folded dipole antenna of claim 7 wherein said switching is accomplished by filter circuits tuned to different resonance frequencies.

10. The folded dipole antenna of claim 7 wherein said lengths of said different lengths are binary-graded.

11. The folded dipole antenna of claim 7 wherein the tuning step width of the non-emitting conductor pieces is chosen to correspond to the desired voltage standing wave ratio bandwidth.

12. The folded dipole antenna of claim 7 wherein a device for performing said switching is built into a housing attached to said dipole emitters.

13. The folded dipole antenna of claim 1 wherein said folded dipole antenna may be used as a transmitting antenna, a receiving antenna, a reflector, or a director.

14. The folded dipole antenna of claim 1 wherein at least one of said dipole emitters is constructed as a hollow tube and wherein said non-emitting conductor piece is accommodated in said hollow tube.

15. The folded dipole antenna of claim 14 wherein said hollow tube is connected to a length switching device via a half wavelength (lambda/2) or multiple wavelength (n*lambda) long extension line.

16. The folded dipole antenna of claim 1 further comprising: an adapter circuit with a transformer which has several taps which are connected in each case to connections of the folded dipole antenna via series resonance circuits; wherein the resonance frequencies are chosen to correspond to successive user bands and are additionally dimensioned such that the imaginary part of the dipole impedance is compensated.

17. The folded dipole antenna of claim 1 wherein said first dipole emitter is a fed dipole emitter and comprises several parallel emitters, and wherein the transformation ratio at the feed point can be switched over via a switching device assigned to said parallel emitters.

18. A folded monopole antenna for receiving signal of a particular wavelength (lambda), the antenna comprising:

two monopole emitters, each of said monopole emitters having a first end, a second end, and a length therebetween, said first monopole emitter being arranged parallel to said second monopole emitter and each of said lengths being less than one quarter said wavelength (lambda/4) associated with said folded dipole antenna; and a non-emitting conductor piece attached to both said first end of said first monopole emitter and said first end of said second monopole emitter;

wherein said second end of said first monopole emitter and said second end of said second monopole emitter are on a conducting plane.

19. The folded monopole antenna of claim 18 wherein each of said lengths is between about 5% and about 10% of said wavelength.

20. The folded monopole antenna of claim 19 wherein each of said lengths is about 6% of said wavelength.

21. The folded monopole antenna of claim 18 wherein at least one of said first non-emitting conductor piece and said second non-emitting conductor piece are accommodated in an electromagnetic shield.

22. The folded monopole antenna of claim 18 wherein at least one of said first non-emitting conductor piece and said second non-emitting conductor piece comprises a two wire line short-circuited at the end.

23. The folded monopole antenna of claim 18 wherein at least one of said first non-emitting conductor piece and said second non-emitting conductor piece comprises a co-axial cable short-circuited at the end, the inner conductor of said co-axial cable being connected to said first monopole emitter, the outer conductor of said co-axial cable being connected to said second monopole emitter.

24. The folded monopole antenna of claim 18 wherein at least one of said first non-emitting conductor piece and said second non-emitting conductor piece can be switched over to two or more different lengths.

25. The folded monopole antenna of claim 24 wherein said switching is accomplished by relay switches assigned to said monopole emitters.

26. The folded monopole antenna of claim 24 wherein said switching is accomplished by filter circuits tuned to different resonance frequencies.

27. The folded monopole antenna of claim 24 wherein said lengths of said different lengths are binary-graded.

28. The folded monopole antenna of claim 24 wherein the tuning step width of the non-emitting conductor pieces is chosen to correspond to the desired voltage standing wave ratio bandwidth.

29. The folded monopole antenna of claim 24 wherein a device for performing said switching is built into a housing attached to said monopole emitters.

30. The folded monopole antenna of claim 18 wherein said folded monopole antenna may be used as a transmitting antenna, a receiving antenna, a reflector, or a director.

31. The folded monopole antenna of claim 18 wherein at least one of said monopole emitters is constructed as a hollow tube and wherein said non-emitting conductor piece is accommodated in said hollow tube.

32. The folded monopole antenna of claim 18 wherein said hollow tube is connected to a length switching device via a half wavelength (lambda/2) or multiple wavelength (n*lambda) long extension line.

33. The folded monopole antenna of claim 18 further comprising: an adapter circuit with a transformer which has several taps which are connected in each case to connections of the folded monopole antenna via series resonance circuits; wherein the resonance frequencies are chosen to correspond to successive user bands and are additionally dimensioned such that the imaginary part of the monopole impedance is compensated.

34. The folded monopole antenna of claim 18 wherein said first monopole emitter is a fed monopole emitter and comprises several parallel emitters, and wherein the transformation ratio at the feed point can be switched over via a switching device assigned to said parallel emitters.

* * * * *